United States Patent [19]

Berthold et al.

[11] Patent Number: 4,934,253

[45] Date of Patent: Jun. 19, 1990

[54] AXIAL PISTON PUMP

[75] Inventors: Heinz Berthold, Horb; Ivan Pecnik, Nagold, both of Fed. Rep. of Germany

[73] Assignee: Brueninghaus Hydraulik GmbH, Horb, Fed. Rep. of Germany

[21] Appl. No.: 283,622

[22] Filed: Dec. 13, 1988

[30] Foreign Application Priority Data

Dec. 18, 1987 [DE] Fed. Rep. of Germany ..... 3743125

[51] Int. Cl.[5] ..... F04B 1/20

[52] U.S. Cl. ..... 91/506

[58] Field of Search ..... 91/482, 485, 499, 506, 91/6.5

[56] References Cited

U.S. PATENT DOCUMENTS

| | | | |
|---|---|---|---|
| 3,585,901 | 6/1971 | Moon, Jr. et al. | 91/499 |
| 3,890,883 | 6/1975 | Rometsch et al. | 91/499 |
| 4,034,652 | 7/1977 | Huebwer | 91/499 |

FOREIGN PATENT DOCUMENTS

| | | | |
|---|---|---|---|
| 1939297 | 2/1971 | Fed. Rep. of Germany | 91/499 |
| 3049538 | 9/1981 | Fed. Rep. of Germany . | |
| 3233579 | 9/1984 | Fed. Rep. of Germany . | |
| 2582738 | 12/1986 | France . | |

*Primary Examiner*—Leonard E. Smith

*Attorney, Agent, or Firm*—Scully, Scott, Murphy & Presser

[57] ABSTRACT

In an axial piston pump of fixed or adjustable displacement having a two-part housing, namely a housing part accommodating the pistons and a connecting part through which the pressure passage and the suction passage extend, the suction passage having a suction opening with a larger cross-section than that of the pressure passage, the connecting part can be mounted to the housing part as desired in two positions turned substantially through 180° about the center axis of the axial piston engine. This construction enables the pump to be adapted to operate with either direction of displacement with little trouble and expense.

13 Claims, 3 Drawing Sheets

38
16
37
33,34
74
92
24
23
5
36
91
33,34
74
24
23
37
38

AXIAL PISTON PUMP

TECHNICAL FIELD OF THE INVENTION

The invention relates to an axial piston pump.

BACKGROUND OF THE INVENTION AND PRIOR ART

When using an axial piston pump in an open circuit cavitation problems arise in the region of the suction opening of the axial piston engine if care is not taken to provide a satisfactory amount of hydraulic medium to be taken in. It is known to solve this problem by making the suction opening in the connecting piece of the axial piston pump larger than the output opening on the pressure side. With this arrangement the direction of displacement of the axial piston machine is predetermined, and it is therefore not possible to change the direction of displacement. In order to be able to use such an axial piston pump for both directions of displacement the art has gone over to providing two mirror image connecting pieces for the axial piston pump. By interchanging the connecting pieces such an axial piston pump can be adapted to the desired direction of displacement. An arrangement of this kind is very inconvenient, not only because two connecting pieces have to be provided, but also because the connecting piece not being used requires a storage space so that it is available when required.

OBJECT OF THE INVENTION

It is an object of the invention to design an axial piston pump of the kind described in the introduction so that it can be adapted to either direction of displacement with little trouble.

BRIEF DESCRIPTION OF THE INVENTION

In the arrangement according to the invention the axial piston pump can be adapted to the desired direction of displacement by rotating the control part through 180°. It therefore does not require an additional connecting piece as is the case with the known arrangement. While rotating the connecting piece changes the position of the suction and outlet openings relative to the axial piston pump or the machine to which they are connected, this problem can be solved in a simple manner by the use of flexible connecting lines or suitable connecting line sections.

Changing over the axial piston pump according to the invention is therefore very simple because it merely requires the fastening screws for the connecting piece to be unscrewed and removed. After this the connecting piece can be rotated through 180° in a simple manner, for which a centering attachment, circular in cross-section, provided between the connecting piece and the housing of the axial piston engine, can advantageously serve as a pivot bearing.

The arrangement according to the invention is suitable for axial piston pumps of the kind in which the change in the direction of displacement is effected by changing the direction of rotation of the drive shaft or, in the case of axial piston pumps of adjustable displacement, by adjusting the adjusting device through the zero point.

Preferred features makes it possible to adapt axial piston pumps of the kind in which the control plates are formed asymmetrically, with regard to the control openings (control kidneys), in a known manner, or have in a known manner so-called pressure balancing passages. and practical passage guide for pressurising the adjusting device of the axial piston pump is disclosed which can function and is advantageous in both assembly positions of the connecting piece.

Also disclosed is an integrated hydraulic adjusting device for an axial piston pump having a small and/or compact, and also simple constructional form, also with regard to individual parts concerned.

In one arrangement tilting out of the swash plate is effected by means of the transmission forces of the axial piston pump so that no additional tilting-out mechanism is needed. Furthermore the swash plate can be attached and detached simply and easily. Additional preferred features ensure simple and economical manufacture, wherein the bearing elements can be made from complete balls by a finishing operation such as turning.

Mechanical stops are disclosed in particular for preventing the tilt disc from overtilting when tilting-in at high speed.

In the arrangement according to claim 14 the bearing with the higher load may be provided intermittently with oil under pressure by the pistons from the sliding path of the swash plate, depending on the operating pressure, and is thus advantageously lubricated. This arrangement makes operation with little friction and wear and with short adjusting times possible.

BRIEF DESCRIPTION OF THE DRAWINGS

The invention will now be described in more detail with reference to preferred exemplary embodiments shown in the drawings, in which.

DETAILED DESCRIPTION OF PREFERRED EMBODIMENTS OF THE INVENTION

Figure 1:
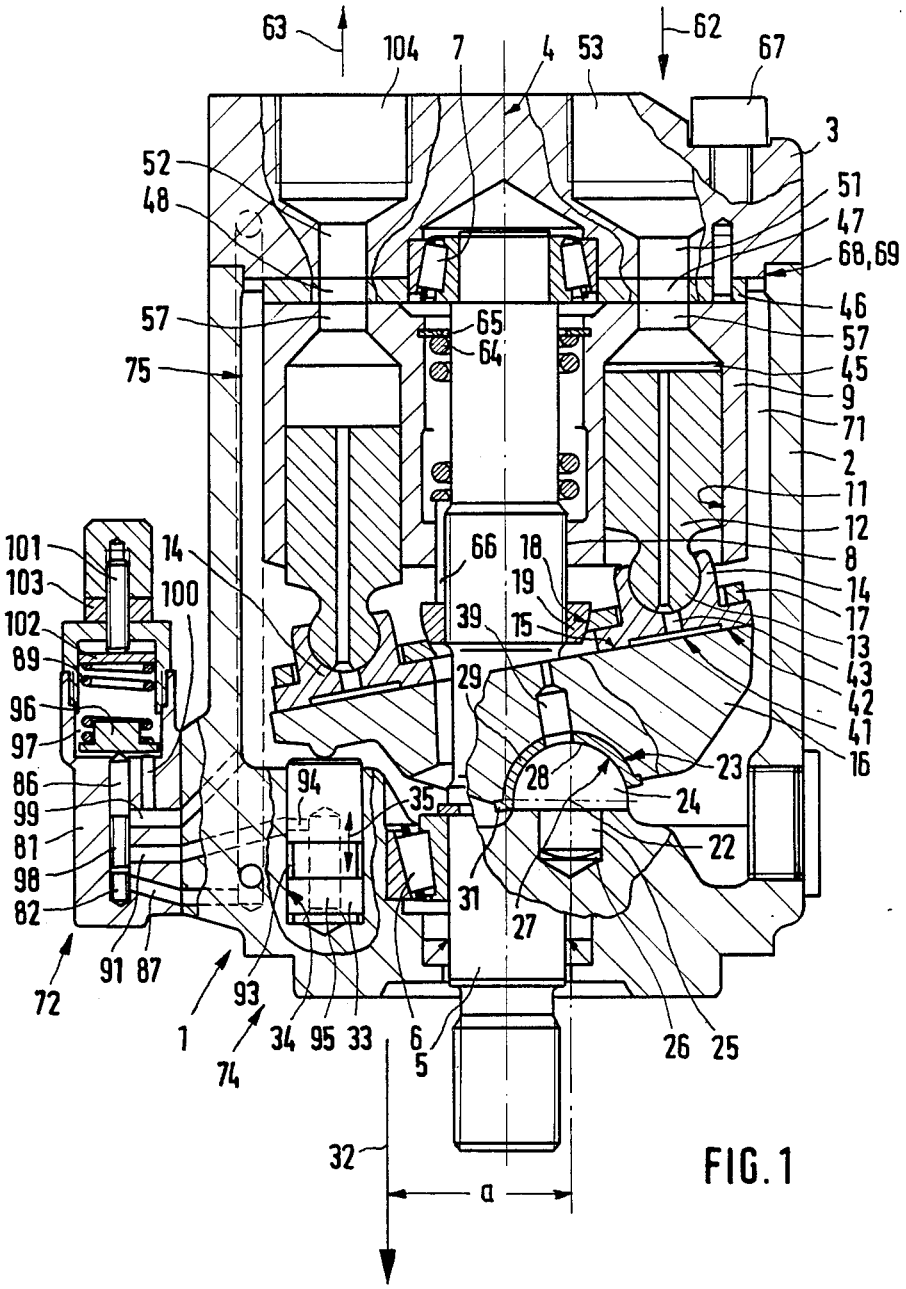
FIG. 1 shows, in axial section, an axial piston pump of the swash plate type formed according to the invention.

The axial piston pump, indicated generally by 1 in FIG. 1, has a two-part housing comprising a pot-shaped housing part 2 and a connecting plate 3 in which a drive shaft 5, extending along the center axis 4, is supported in roller bearings 6,7 of which one is associated with the pot-shaped housing part 2 and the other with the connecting plate 3. On the drive shaft 5 a cylinder drum 9 is supported on a splined section indicated by 8 and has a plurality of cylinder bores 11 distributed uniformly on a pitch circle in which the pistons 12 are accommodated. The pistons 12 have spherical heads 13 which engage in slippers 14 which fit against the sliding surface 15 of a swash plate 16. The contact with the sliding surface 15 is maintained by a withdrawal plate 17 which, in the present exemplary embodiment, is mounted with a part-spherical recess 18 on a spherical head-shaped supporting piece 19. The supporting piece 19 is mounted on the drive shaft 5 so as to be longitudinally displaceable.

The swash plate 16 is mounted about a tilting axis 22 in a pivot bearing which is formed by two supports, indicated generally by 23, lying one behind the other along the tilting axis 22, comprising two mushroom-shaped bearing parts 24 which are inserted with their circular stems 25 in bores 26 in the floor of the pot-shaped housing part 2 and which engage in spherical recesses 27 on the rear side of the swash plate 16. The spherical convex surfaces of the bearing parts 24 facing the piston and the spherical concave surfaces of the recesses 27 thus form bearing surfaces 28 on the housing and on the swash plate sides. In the present exemplary embodiment cup-shaped bearing shells 29 are inserted in the recesses 27, each having a radially projecting collar 31 fitting on the peripheral edge of the recesses 27 and thus being secured against tilting movements.

Figure 2:
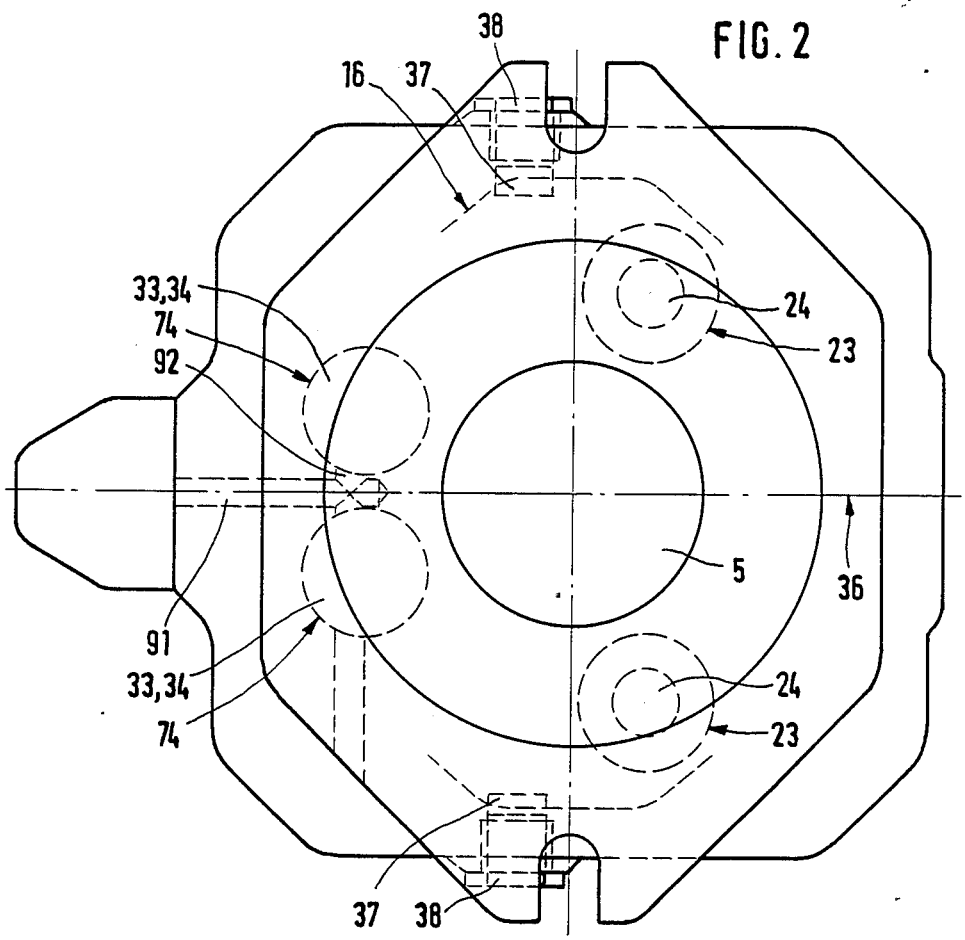
FIG. 2 shows the axial piston pump in a view from below.

The tilting axis 22 of the swash plate 16 is at a distance a from the working line of the piston force 32 resulting from the forces of the active pistons 12, this distance a extending past the center axis 4. The resulting piston force 32 is produced by the pistons 12 on the respective pressure side. Because of the distance a, when the axial piston pump 1 is in operation the swash plate 16 is loaded anti-clockwise by torque as shown in FIG. 1. As a result of this, abutment of the swash plate 16 against the hydraulic adjusting pistons 33 effecting its adjustment is ensured, said pistons being arranged parallel to the drive shaft 5 in the floor or flange part of the pot-shaped housing part 2 and being hydraulically displaceable in cylinder bores 34 with their axes parallel to the drive shaft 5, i.e. in the direction of the double arrow 35. The adjusting pistons 33 are arranged opposite to the resulting effective piston force 32, i.e they are, in relation to the tilting axis 22, on the other side of the axial piston pump 1 and are at the same distance from the center axis 4 and arranged quite close to one another and symmetrical to a transverse axis 36 extending at right angles to the tilting axis 22 (cf. FIG. 2). In the position shown in FIG. 1, the swash plate 16 is in its position of maximum piston stroke. By advancing the adjusting pistons 33 the swash plate 16 can be displaced about the tilting axis 22 into desired tilt positions or displacement positions. To limit the maximum tilt position stops 37 are arranged on either side of the axial transverse plane 36 approximately opposite the adjusting piston 33. These comprise bolts or screws 38 with stop pins inserted laterally from the outside in to the housing part 2. When it is up against the stops 37 the axial piston engine 1 is set at minimum piston stroke and minimum displacement.

The pivot bearings 23 are each connected to the oil-supply system of the axial piston engine 1 by a respective lubricating passage 39 extending from the recess 27 and passing through the bearing shell 29 and the swash plate 16, and are thus lubricated with oil. In the present exemplary embodiment the lubricating passage 39 ends in the sliding surface 15 of the swash plate 16 near the pitch circle on which the pistons are arranged, namely in a region which the slippers 14 sweep with a recess 41 in their sliding surface 42. The recess 41 is connected to the working chambers 45 of the piston cylinder by means of known axial passages 43, 44 in the slippers 14 and the pistons 12. In this manner, when the axial piston pump 1 is in operation the respective bearing point of the pivot bearing 23 with the higher load is provided intermittently with lubricating oil under working pressure when the slipper 14 sweeps over it.

The cylinder drum 9 lies with its front end facing away from the swash plate 16 against a control plate 46 which is arranged between the cylinder drum 9 and the connecting plate 3 and is mounted non-rotatably about the middle axis 4 on the connecting plate 3. The control plate 46, shown in detail in FIG. 3, has passing through it two substantially kidney-shaped openings 47, 48 connected to which are—likewise kidney-shaped—suction and pressure passages 51,52 in the connecting plate 3. The suction passage 51 has an enlarged end cross-section compared with that of the pressure passage 52, namely a large suction opening 53, in this case a connection for a suction line (not shown). In the present exemplary embodiment the control kidney 48 is interrupted on the pressure side by reinforcing ribs 50.

Figure 3:
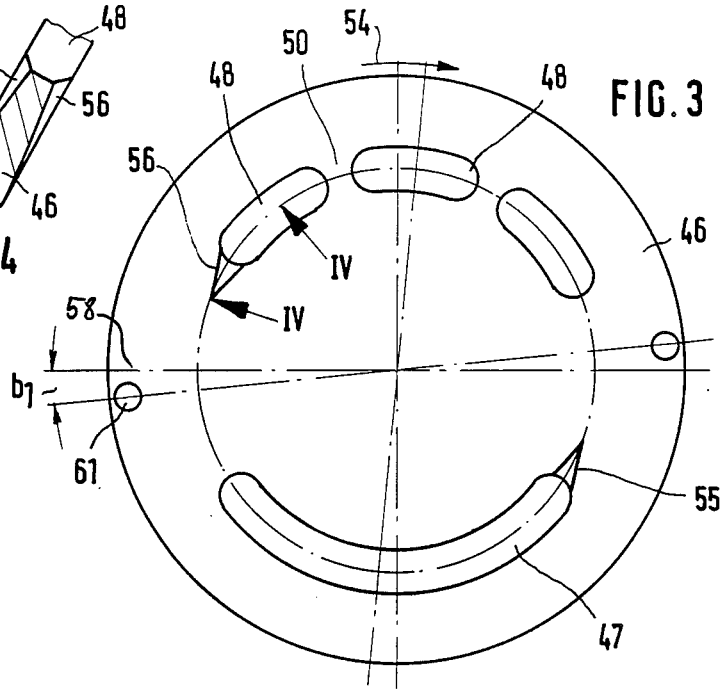
FIG. 3 shows a control plate of the axial piston pump in a plan view.

Arranged at the ends of the control kidneys 47, 48 which are opposed to the respective direction of rotation, shown by way of example in FIG. 3 by the arrow 54, are known pressure balancing notches 55, 56 whose purpose is to reduce the sudden effect of the pressure changes in the working chambers 45 when the control passages 57 in the cylinder drum 9 extending from the working chambers 45 come into connection with the control kidney 46, 48 containing the high or low pressure.

In the present exemplary embodiment the control plate 46 has pressure balancing notches 55 on both sides, namely at one and the same end of at least the high pressure control kidney 48. That is to say, on the rear side of the control plate 46 shown in FIG. 3 there are also pressure balancing notches 55, 56 behind the visible pressure balancing notches 55, 56. The pressure balancing notches 55, 56 extend from the respective end of the control kidney 47, 48 and converge in a wedge-shape as is shown in the partial section in FIG. 4. The pressure balancing notch or notches 55 may be arranged on either side of the control plate 46, preferably at the end of the lower pressure control kidney 47 opposed to the direction of rotation 54.

Figure 4:
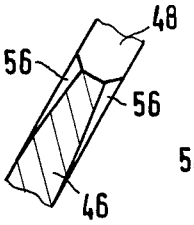
FIG. 4 shows the section IV—IV in FIG. 3.

The control plate 46 is prevented from rotating by means of a mortise and tenon joint having a pin (FIG. 5) preferably extending from the connecting plate 3 which engages in a blind hole or through hole in the control plate 46. The arrangement is such that the control plate 46 can be joined as desired by one or the other of its front ends to the connecting plate 3, and it can be turned substantially about a transverse axis 58 parallel to the transverse axis 36 shown in FIG. 2 so that the control kidneys 47, 48 always correspond with the - likewise kidney-shaped - suction and pressure passages 51, 52 in the connecting plate 3. The arrangement of the pin 60 and a pin hole 61, in this case a through hole, receiving the pin 60 is preferably such that the two mounting positions of the control plate 46 that can be selected are different in relation to the positions determined by the connecting plate 3, namely the one mounting position is displaced relative to the other mounting position in the peripheral direction, as is made clear by the angle shown in FIG. 4 representing a displacement of the pin hole 61 relative to the transverse axis 58. That is to say the control kidneys 47, 48 do not lie symmetrically in relation to the arrangement determined by the control passages 57, namely for functional reasons for the purpose of achieving a specific lead, as is known. The angle $b_1$ in FIG. 3 shows the displacement of the angle in the mounting position with the control plate 46 turned over.

In the present exemplary embodiment the control plate 46 has a parallel shape.

When in operation the cylinder drum 9 is made to rotate by the drive shaft 5. The cylinder bores 11 thus alternately come into connection with the control kidneys 47, 48 whereby, owing to the movement of the pistons 12, the pump effect occurs in known manner. The direction of flow of the hydraulic medium is illustrated in FIG. 1 by the arrows 62 and 63. Sealing between the cylinder drum 9 and the control plate 46 is ensured by a pressure spring 64 which is inserted between an inner ring 65 of the cylinder drum 9 and a pressure ring. Extending between the pressure ring and the supporting piece 19 is at least one axial pressure element, in the present exemplary embodiment in the form of three pressure pins 66 distributed on the periphery which are axially 10 displaceable in a guide in the cylinder drum 9. By means of the pressure spring 64 the cylinder drum 9 is thus elastically urged against the control plate 46 and the supporting piece 19 against the withdrawal plate 17, and consequently, also the swash plate 16 against the bearing 23. A similar object could also advantageously be achieved by, e.g. pressure springs arranged in the cylinder bores 11 which urge the pistons 12 towards the swash plate 16.

The connecting plate 3 is formed so that it can if desired be mounted in a position turned through 180° about the middle axis 4. This applies particularly, in the present exemplary embodiment, to the four fastening screws 67 distributed uniformly on a pitch circle and to the arrangements relating to the control means, such as the kidney-shaped suction and pressure passage sections 51, 52, the mortise and tenon joint between the connecting plate 3 and the control plate 46, and the centering ring on the connecting plate 3, indicated generally by 68 and having a circular projection 69 which engages substantially sealingly in the space 71, likewise circular in cross-section, in the housing. The connecting plate 3 can thus, after unscrewing and removing the fastening screws 67, be rotated through 180° and secured again. By simultaneously turning the control plate 46 over into the other or correct functional position the axial piston engine 1 can in a simple manner be adapted to a reversal of the direction of displacement, and the suction opening 53 having the larger cross-section can be arranged in the position determined by the reversal of the direction of flow, namely as desired on one or the other side of the axial piston engine 1, so that trouble-free suction or trouble-free filling of the sucking piston cylinder is achieved.

In the present exemplary embodiment the connecting plate 3 is made of drawn section material preferably having a rectangular cross-section. This makes economical manufacture possible. The fastening screws 67 are arranged in the corner regions of the connecting plate 3 in positions opposite one another.

Mounting and dismounting the swash plate 16 is very simple because after the removal of the connecting plate 3 it can be inserted in the housing part 2, either alone or pre-mounted on the drive shaft 5 as a unit, from the open side of the housing, and be removed again in the opposite direction.

In the present exemplary embodiment, in order to adjust the displacement of the axial piston pump 1, a valve, generally indicated by 72, is provided with which it is possible to control the displacement setting depending on the working pressure, so that with increasing working pressure displacement is reduced and with falling working pressure displacement is increased (pressure control), or else the displacement is limited only depending on pressure.

For this purpose the valve 72 is connected in a passage leading from the pressure passage 52 to the working chambers 73 of the adjusting cylinder, indicated generally by 74, so as to regulate or control the loading of the adjusting pistons 33. This connecting passage, comprising a plurality of sections and indicated by 75, is connected to the pressure passage 52 in the region of the connecting plate 3. In order to ensure the hydraulic supply of the adjusting cylinder 74 and the reduction in the working pressure in both mounting positions of the connecting plate 3 turned through 180° two connecting passages 76, 77 (FIG. 5) are provided in the connecting plate 3, drilled from the outside and sealed, of which the one connecting passage branch 76 in the one mounting position and the other connecting passage branch 77 in the other, 180° rotated, mounting position of the connecting plate 3 corresponds with the interface (FIG. 1), indicated by 78, with the connecting passage 75. This interface 78 is in the joint between the housing part 2 and the connecting plate 3 and it is sealed from the joint in a manner not shown.

From this interface 78 the connecting passage 75 extends at first axially in the housing part 2 into the region of the valve 72, which is attached thereto laterally and preferably symmetrically on a mounting surface 79 and secured in a manner not shown, the valve housing being indicated generally by 81. In the present exemplary embodiment the valve 72 comprises a valve spool 82 with a collar having control edges on either side, said collar forming a variable valve opening with a connecting passage section 87 extending from the bore 86 accommodating the valve spool 82 to the working chambers 73. The valve spool 82 is urged at its upper end in FIG. 1 by a spring 89 into a position closing the valve opening When there is a, or a specified, working pressure, the spool 82 is pushed up against the spring 89, whereby the opening into the connecting passage section 87 is opened and the adjusting pistons 33 are advanced hydraulically by means of connecting passage branches 91, 92 (FIG. 2) so as to reduce or limit the displacement. The connecting passage sections 91, 92 are each connected to the working chambers 73 of the adjusting cylinder 74 via a peripheral groove 93 and a radial and axial connecting passage section 94, 95 (FIG. 1) in the adjusting piston 33.

Venting of the adjusting cylinder 74 and of the space 97 accommodating the spring 89 and a pressure plate 96 is ensured by venting passage sections 98,99, 100 which are connected to the housing space 71 of the pump housing. In the present exemplary embodiment the venting passage section 98 is formed by the section of the bore 86 lying behind the collar, i.e. this venting passage section 98 leads from the valve opening and is closed by the collar when the adjusting piston 33 is loaded.

The bias force of the spring 89 can be adjusted by an adjusting screw 101 on which the spring 89 is supported through a spring control element 102. The adjusting screw 101 can be secured by a nut 103.

Within the scope of the invention it is possible to form the valve 72 and make the arrangement such that it is only possible to adjust the swash plate 16 between two positions, namely between the maximum and minimum settings.

Figure 5:
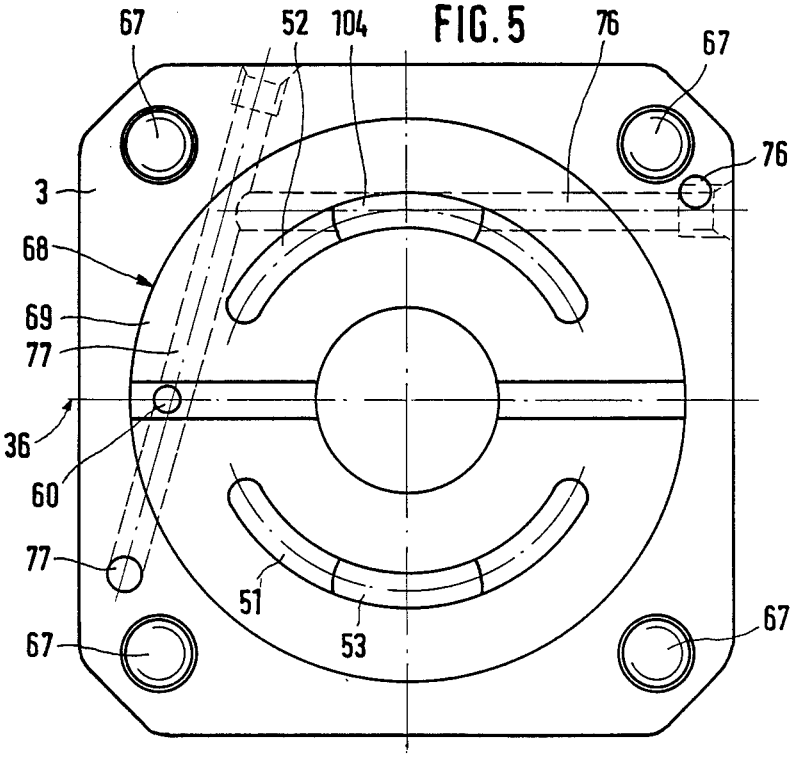
FIG. 5 shows the connecting plate of the axial piston pump in plan view.

It is also possible within the scope of the invention to use as the control disc a control plate 46 whose control kidneys 47, 48 are arranged symmetrically in relation to the transverse plane 36, also indicated in FIG. 5. As to this, it is to be noted that the suction opening 53 with the larger cross-section, the output opening 104 with the smaller cross-section, the suction and pressure passages 51, 52 and the control kidneys 47, 48 are, for better clarity, shown in FIG. 1 turned through 90° as illustrated by a broken line. In reality the aforementioned features of the arrangement lie on either side of the transverse plane 36 (see FIG. 5) which is also the plane of the section shown in FIG. 1 and in which the transverse axis 58 also lies.

Depending on the use of the axial piston pump 1, it is also not absolutely necessary to provide pressure balancing notches in the control disc 46. In a case such as this, the adaptation of the axial piston pump 1 in relation to the reversal of the control disc 46 can also be done by turning the control disc or control plate 46 through substantially 180° about the middle axis 4, as opposed to be being turned over as in the previously described exemplary embodiment. An arrangement such as this is thus also functionally capable of adapting the axial piston pump 1 to the reversal of the direction of displacement.

In the exemplary embodiment shown in FIG. 1 the reversal of the direction of displacement is achieved by changing the direction of rotation of the drive shaft 5. A reversal in the direction of displacement can, however, also be achieved if the adjusting device of the axial piston pump can, unlike in the exemplary arrangement shown in FIG. 1, be adjusted through the zero-point.

What is claimed is:

1. An axial piston pump of the swash plate type, having a two-part housing, including a housing part accommodating the pistons, and a connecting piece through which the pressure passage and the suction passage extend, wherein the suction passage has a larger cross-sectional suction opening then the pressure passage, the pistons are arranged in a rotatable cylinder drum and a control disc having control openings is arranged between the cylinder drum and the connecting piece, characterized in that the connecting piece can be mounted on the housing part in two alternative positions turned substantially through 180° about the center axis of the axial piston pump; and the control disc can be mounted as desired in two mounting positions which, in relation to one another, are turned substantially through 180° about the center axis of the axial piston pump or are turned about a transverse axis extending substantially centrally of the control openings.

2. An axial piston pump according to claim 1, wherein the control openings in the control disc are slightly offset (angle b) in the circumferential direction relative to the transverse axis.

3. An axial piston pump according to claim 1, wherein the control disc has pressure balancing passages on both front faces at the ends opposite the direction of rotation of the axial piston pump.

4. An axial piston pump of the swash plate type, having a two-part housing, including a housing part accommodating the pistons, and a connecting piece through which the pressure passage and the suction passage extend, wherein the suction passage has a larger cross-sectional suction opening than the pressure passage, characterized in that the connecting piece can be mounted on the housing part in two alternative positions turned substantially through 180° about the center axis of the axial piston pump; and the swash plate is arranged on two bearing parts spaced apart and having free spherical bearing surfaces facing the pistons, loosely between the bearing parts and the pistons, wherein the swivel axis extending through the bearing parts is at a distance (a) from the corresponding direction of force of the pistons and at least one adjusting piston presses loosely against the side of the swash plate remote from the pump pistons.

5. An axial piston pump according to claim 4, wherein the bearings parts are mushroom-shaped and are inserted with their stems in holes in the housing part or parts built thereon.

6. An axial piston pump according to claim 4, wherein the heads of the pistons are pivotably mounted in slippers which abut against the drive disc, and wherein a respective lubricating passage is provided which extends from the recess in the swash plate accommodating ;the respective bearing, through the swash plate and emerges at its inclined surface, and which corresponds with lubricating passages which extend longitudinally through the pistons and the slippers.

7. An axial piston pump of the swash plate type, having a two-part housing including a housing part accommodating the pistons, and a connecting piece through which the pressure passage and the suction passage extend, wherein the suction passage has a larger cross-sectional suction opening than the pressure passage, characterized in that the connecting piece can be mounted on the housing part in two alternative positions turned substantially through 180° about the center axis of the axial piston pump; and the swash plate can be adjusted by at least one adjusting cylinder which is connected to the pressure passage within the connecting piece by a connecting passage extending through the housing part and the connecting piece, wherein the connecting passage has, in the region of the connecting piece, two connecting passage sections, of which one connecting passage section in one mounting position and the other connecting passage section in the other mounting position of the connecting piece are in fluid communication with the connecting passage extending in the housing part.

8. An axial piston pump according to claim 7, wherein the adjusting cylinder is integrated in the flange or floor of the housing part.

9. An axial piston pump according to claim 7, wherein two adjusting cylinders are provided of which the adjusting pistons are arranged next to one another on an imaginary pitch circle.

10. An axial piston pump according to claim 7, wherein the maximum tilting position of the swash plate is limited by the adjusting piston being pushed right up against a stop.

11. An axial piston pump according to claim 7, wherein, associated with the swash plate on the side on which the at least one adjusting cylinder is arranged, is at least one stop to limit its minimum tilt position which is preferably formed by a screw screwed from the outside into the housing part.

12. An axial piston pump according to claim 7, wherein the at least one adjusting cylinder can be controlled or regulated by a control or regulating valve acted on by working pressure.

13. An axial piston pump according to claim 12, wherein the control or regulating valve is arranged laterally on the housing part, opposite the adjusting cylinder, in particular in a position symmetrical with respect to two adjusting cylinders.

* * * * *

UNITED STATES PATENT AND TRADEMARK OFFICE

CERTIFICATE OF CORRECTION

PATENT NO. : 4,934,253

DATED : June 19, 1990

INVENTOR(S) : Berthold Heinz

It is certified that error appears in the above-identified patent and that said Letters Patent is hereby corrected as shown below:

Column 2, line 2: "and practical" should read as --A simple and practical--

Column 2, line 21: delete "In the arrangement according to claim 14" and "the" should read as --The--

Column 5, line 11: delete "10"

Column 6, line 32: "opening When" should read as --opening. When--

Column 8, line 6, Claim 5: "bearings" should read as --bearing--

Column 8, line 14, Claim 6: delete ";"

Signed and Sealed this

Twenty-second Day of October, 1991

*Attest:*

*Attesting Officer*

HARRY F. MANBECK, JR.

*Commissioner of Patents and Trademarks*